US011261697B2

(12) United States Patent
Tusing et al.

(10) Patent No.: US 11,261,697 B2
(45) Date of Patent: Mar. 1, 2022

(54) MODULAR HYDRAULIC INTENSIFICATION SYSTEM FOR DOWNHOLE EQUIPMENT FUNCTION AND CHEMICAL INJECTION SERVICES

(71) Applicant: OneSubsea IP UK Limited, London (GB)

(72) Inventors: Adam Tusing, Houston, TX (US); Greg Manson, Katy, TX (US)

(73) Assignee: ONESUBSEA IP UK LIMITED, London (GB)

( * ) Notice: Subject to any disclaimer, the term of this patent is extended or adjusted under 35 U.S.C. 154(b) by 30 days.

(21) Appl. No.: 16/910,117

(22) Filed: Jun. 24, 2020

(65) Prior Publication Data

US 2020/0399981 A1 Dec. 24, 2020

Related U.S. Application Data

(60) Provisional application No. 62/865,372, filed on Jun. 24, 2019.

(51) Int. Cl.
*E21B 34/04* (2006.01)
*E21B 33/064* (2006.01)
*F15B 3/00* (2006.01)

(52) U.S. Cl.
CPC ..... *E21B 34/045* (2013.01); *E21B 33/064* (2013.01); *F15B 3/00* (2013.01)

(58) Field of Classification Search
CPC ..... E21B 34/045; E21B 33/064; E21B 3/00
USPC ..... 166/360
See application file for complete search history.

(56) References Cited

U.S. PATENT DOCUMENTS 3,773,438 A * 11/1973 Hall ..... E21B 43/26 417/345
9,222,326 B2 12/2015 Whitby et al.
2009/0317267 A1* 12/2009 Gill ..... F15B 3/00 417/53
2013/0175045 A1* 7/2013 Rytlewski ..... E21B 33/0355 166/363
2013/0227941 A1* 9/2013 Kim ..... F15B 3/00 60/459
2017/0037702 A1* 2/2017 Gaude ..... E21B 34/16
2019/0032437 A1* 1/2019 Daley ..... E21B 33/061
2020/0408226 A1* 12/2020 Dwornik ..... E21B 33/0355

* cited by examiner

*Primary Examiner* — Matthew R Buck
*Assistant Examiner* — Patrick F Lambe
(74) *Attorney, Agent, or Firm* — Eileen Pape

(57) ABSTRACT

A modular hydraulic intensification system includes a housing configured to be deployed within a subsea landing string. The modular hydraulic intensification system also includes multiple hydraulic intensifiers positioned within the housing, wherein each hydraulic intensifier includes a first chamber configured to fluidly couple to a hydraulic fluid supply and a second chamber configured to fluidly couple to one or more landing string valves within a lower portion of the subsea landing string. The modular hydraulic intensification system further includes a shuttle valve fluidly coupled to the respective second chambers of the multiple hydraulic intensifiers, wherein the shuttle valve is configured to enable flow of an output fluid across the shuttle valve from the respective second chambers of the multiple hydraulic intensifiers and to block backflow of the output fluid across the shuttle valve toward the respective second chambers of the multiple of hydraulic intensifiers.

20 Claims, 4 Drawing Sheets

MODULAR HYDRAULIC INTENSIFICATION SYSTEM FOR DOWNHOLE EQUIPMENT FUNCTION AND CHEMICAL INJECTION SERVICES

CROSS-REFERENCE TO RELATED APPLICATION

This application claims priority to and the benefit of U.S. Provisional Application No. 62/865,372, entitled "MODULAR HYDRAULIC INTENSIFICATION SYSTEM FOR DOWNHOLE EQUIPMENT FUNCTION AND CHEMICAL INJECTION SERVICES," filed Jun. 24, 2019, which is hereby incorporated by reference in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

In subsea operations, hydrocarbon fluids (e.g., oil and natural gas) are obtained from a subterranean geologic formation, referred to as a reservoir, by drilling a well that penetrates the subterranean geologic formation. Subsea equipment is positioned at the well and operated, at least in part, via hydraulic actuating fluid supplied from a surface via a control line system. Some existing control line systems may provide the hydraulic actuating fluid at a pressure of about 68 Megapascal (MPa) or 100 MPa (e.g., about 10,000 pounds per square inch [psi] or 15,000 psi). However, as wells are drilled at greater depths, interest has increased in control line systems that are designed to provide the hydraulic actuating fluid at greater pressures, such as about 138 MPa (e.g., 20,000 psi) or more.

SUMMARY

In an embodiment, a modular hydraulic intensification system for use in a subsea landing string includes a housing configured to be deployed within the subsea landing string. The modular hydraulic intensification system also includes multiple hydraulic intensifiers positioned within the housing, wherein each hydraulic intensifier of the multiple hydraulic intensifiers includes a first chamber configured to fluidly couple to a hydraulic fluid supply and a second chamber configured to fluidly couple to one or more landing string valves within a lower portion of the subsea landing string. The modular hydraulic intensification system further includes a shuttle valve fluidly coupled to the respective second chambers of the multiple hydraulic intensifiers, wherein the shuttle valve is configured to enable flow of an output fluid across the shuttle valve from the respective second chambers of the multiple hydraulic intensifiers toward the one or more landing string valves and to block backflow of the output fluid across the shuttle valve toward the respective second chambers of the multiple hydraulic intensifiers.

In an embodiment, a landing string system include a lower portion configured to be landed within a stack assembly of a subsea system, wherein the lower portion includes one or more valves that are configured to seal a bore to block a flow of well fluid from a wellbore toward a surface. The landing string system also includes a modular hydraulic intensification system coupled to the lower portion, and the modular hydraulic intensification system includes a first hydraulic intensifier and a second hydraulic intensifier, wherein the first hydraulic intensifier and the second hydraulic intensifier each have a respective low-pressure chamber configured to fluidly couple to a hydraulic fluid supply at the surface and a high-pressure chamber configured to fluidly couple to the one or more valves within the lower portion of the landing string system. The modular hydraulic intensification system also includes a shuttle valve fluidly coupled to the respective high-pressure chambers of the first hydraulic intensifier and the second hydraulic intensifier, wherein the shuttle valve is configured to enable flow of an output fluid across the shuttle valve from the respective high-pressure chambers of the first hydraulic intensifier and the second hydraulic intensifier and to block backflow of the output fluid across the shuttle valve toward the respective high-pressure chambers of the first hydraulic intensifier and the second hydraulic intensifier.

In an embodiment, a method of operating a modular hydraulic intensification system includes receiving, at respective low-pressure chambers of multiple hydraulic intensifiers, an input fluid at a first pressure. The method also includes outputting, at respective high-pressure chambers of the multiple hydraulic intensifiers, an output fluid at a second pressure that is greater than the first pressure. The method further includes enabling, via a shuttle valve, the output fluid to flow from the respective high-pressure chambers of the multiple hydraulic intensifiers toward one or more valves of a lower portion of a landing string, and blocking, via the shuttle valve, the output fluid from returning to the respective high-pressure chambers of the multiple hydraulic intensifiers.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
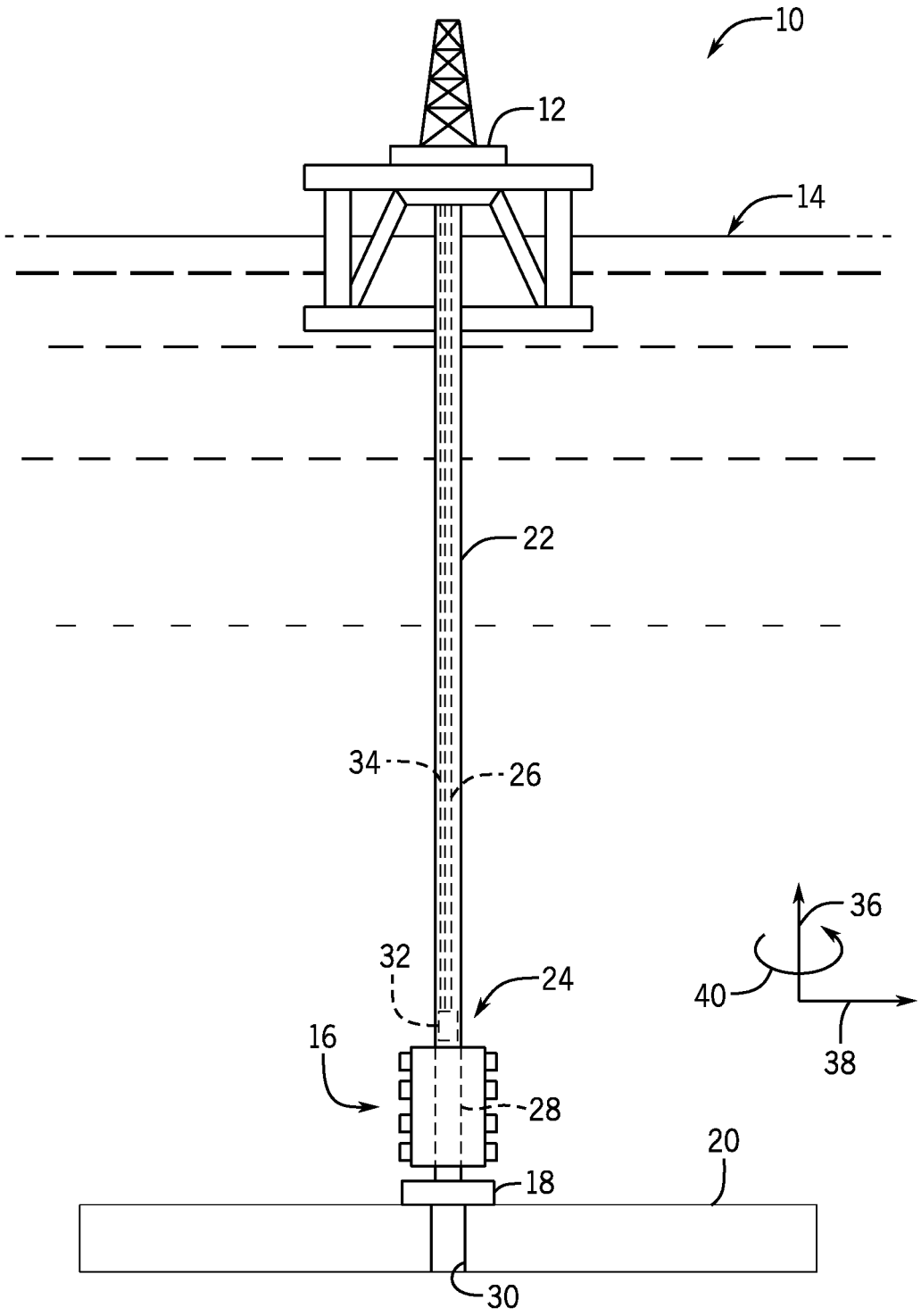
FIG. 1 is a schematic illustration of a subsea system that includes a modular hydraulic intensification system, according to an embodiment of the present disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," "said," and the like, are intended to mean that there are one or more of the elements. The terms "comprising," "including," "having," and the like are intended to be inclusive and mean that there may be additional elements other than the listed elements. The use of "top," "bottom," "above," "below," and variations of these terms is made for convenience, but does not require any particular orientation of the components relative to some fixed reference, such as the direction of gravity. The term "fluid" encompasses liquids, gases, vapors, and combinations thereof.

The disclosure herein generally involves a system and methodology for providing a modular hydraulic intensification system that is able to increase hydraulic pressure. For example, the modular hydraulic intensification system may be used to increase a pressure of a hydraulic actuating fluid to about 138 MPa (e.g., about 10,000 psi) as compared to a more typical pressure (e.g., for control line systems and chemical injection) of about 68 MPa or 100 MPa (e.g., about 10,000 psi or 15,000 psi). The modular hydraulic intensification system may be used with next-generation, ultra-high-pressure landing string equipment and may also allow existing direct hydraulic control systems to be reused for such high-pressure projects.

According to an embodiment, the modular hydraulic intensification system may be used to control subsea equipment, such as components of a landing string system deployed within a marine drilling riser, for example. The modular hydraulic intensification system may include a module (e.g., housing), which may be located near (e.g., above) or within the landing string system and may have a series of hydraulic intensifiers configured for parallel operation. The hydraulic intensifiers may be fed a low to medium pressure supply (e.g., 34 MPa, or 5000 psi, to 100 MPa, or 15,000 psi) and may increase this pressure supply for use in a higher-pressure service (e.g. 138 MPa, or 20,000 psi). Increasing the pressure may enable use of the modular hydraulic intensification system to, for example, maintain open line control pressure on a surface controlled subsea safety valve (SCSSV) and/or to inject chemicals at high pressures into a wellbore. The ability to increase pressure downstream of an umbilical (e.g., at or above a subsea test tree [SSTT]) may enable use of a much less complex and less expensive lower pressure control system. For example, a subsea operation may utilize a lower pressure control system already existing in inventory combined with the modular hydraulic intensification system (e.g., the modular hydraulic intensification system may be retrofitted to the lower pressure control system already existing in inventory).

According to an embodiment, the modular hydraulic intensification system may include a module (e.g., housing) fitted with several hydraulic intensifiers combined with associated hydraulic control accessories, such as filters and/or non-return valves. The modular hydraulic intensification system may also include hydraulic conduits that are used to convey direct and intensified hydraulic actuating fluid to the SSTT, a tubing hanger running tool (THRT), completion equipment, and/or other systems and devices. The modular hydraulic intensification system may be placed in a dedicated sub or mandrel (e.g., housing), which may be inserted into the landing string (e.g., in-line with the landing string), for example. However, the modular hydraulic intensification system, or at least some components thereof (e.g., the hydraulic intensifiers), may be inserted into existing landing string equipment if sufficient space is available.

FIG. 1 is an embodiment of a subsea system 10. As shown, the subsea system 10 includes an offshore vessel or platform 12 at a sea surface 14. A stack assembly 16 (e.g., a blowout preventer (BOP) stack and/or a lower marine riser package (LMRP)) is mounted to a subsea production tree 18 at a sea floor 20. A riser 22 (e.g., marine drilling riser) extends from the platform 12 to the stack assembly 16.

During certain operations (e.g., intervention operations), a landing string 24 (e.g., landing string assembly or system; subsea landing string) may be deployed through the riser 22. The landing string 24 may include a landing string tubular 26 that is positioned within the riser 22. The landing string 24 may include a lower portion 28 (e.g., a valve portion; subsea test tree (SSTT)) that is positioned or landed within the stack assembly 16. The landing string 24 may be used to flow fluids and/or convey tools between the platform 12 and the subsea production tree 18, and the lower portion 28 of the landing string 24 may include one or more valves (e.g., a surface controlled subsurface safety valve (SCSSV) within an subsea test tree (SSTT); a retainer valve) for well control. Downhole operations (e.g., intervention operations) may be carried out by a conduit (e.g., coiled tubing, wireline) that extends from the platform 12, through the landing string tubular 26, through the lower portion 28 of the landing string 24, and into a wellbore 30.

The present embodiments include a modular hydraulic intensification system 32 that is configured to intensify (e.g., increase) a pressure of a hydraulic actuating fluid. In particular, the modular hydraulic intensification system 32 is configured to receive an input fluid (e.g., supply fluid) via one or more umbilicals 34 that extend from the platform 12 to the modular hydraulic intensification system 32. The modular hydraulic intensification system 32 may include one or more hydraulic intensifiers that receive the input fluid and that intensify the pressure of the hydraulic actuating fluid. The modular hydraulic intensification system 32 may then deliver the hydraulic actuating fluid to operate (e.g., to hold open) one or more of the valves of the lower portion 28 of the landing string 24, for example. As shown, a housing of the modular hydraulic intensification system 32 is positioned in line with and above the lower portion 28 of the landing string 24 (e.g., coaxial to and/or between the landing string tubulars 26 and the lower portion 28 of the landing string 24 along a vertical axis or direction 36). To facilitate discussion, the landing string 24 and other components of the subsea system 10 may be described with reference to the vertical axis or direction 36, a radial axis or direction 38, and a circumferential axis or direction 40.

Figure 2:
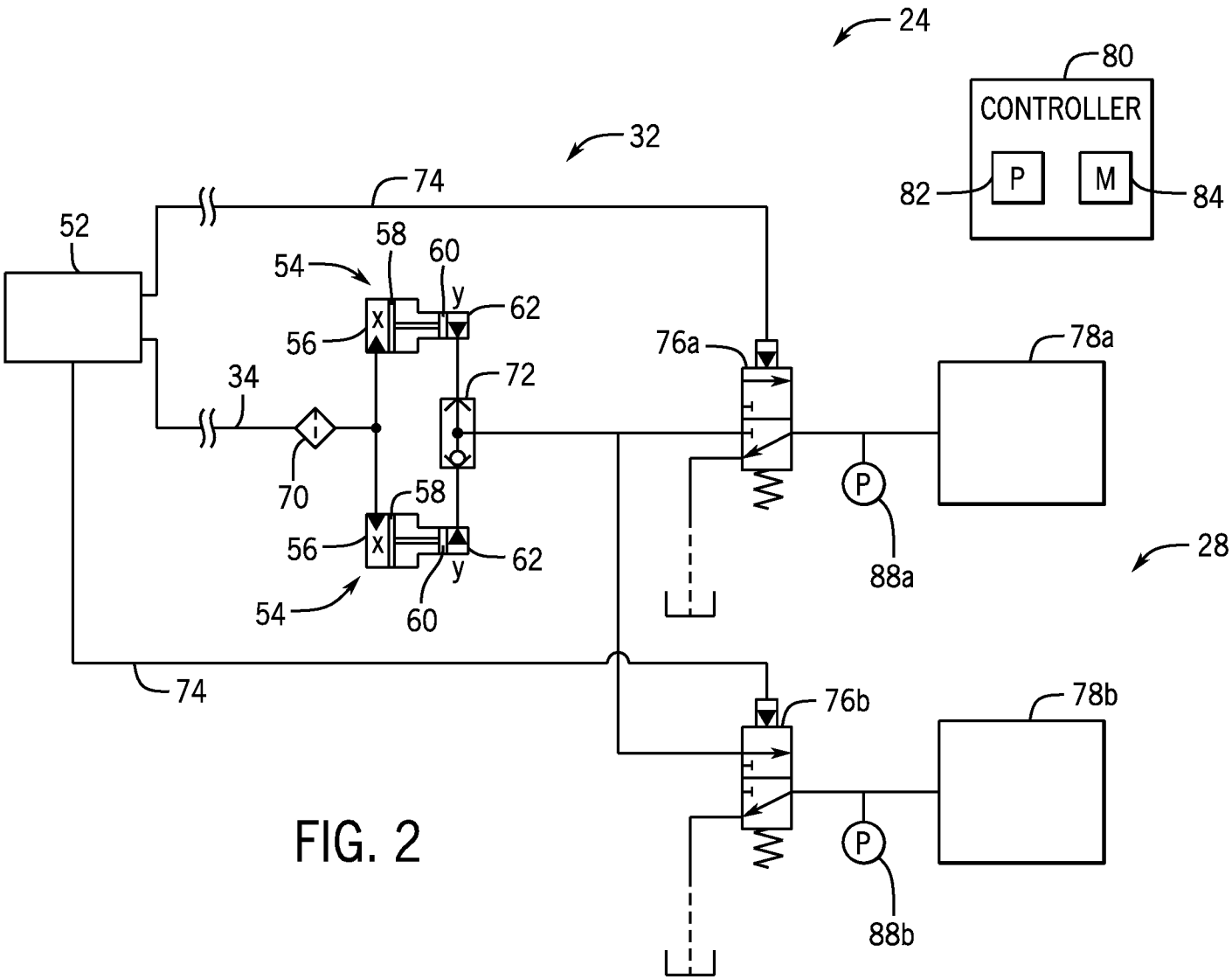
FIG. 2 is a schematic illustration of the modular hydraulic intensification system of FIG. 1, according to an embodiment of the present disclosure.

FIG. 2 illustrates a schematic diagram of an embodiment of the modular hydraulic intensification system 32. In this example, one or more umbilicals 34 extend from a fluid tank 52 (e.g., at the platform 12 of FIG. 1) to multiple hydraulic intensifiers 54. In particular, the one or more umbilicals 34 are configured to provide an input fluid at a first pressure (e.g., about 68 MPa or 100 MPa) from the fluid tank 52 to a first chamber 56 (e.g., low pressure chamber) of each of the multiple hydraulic intensifiers 54. Each of the multiple hydraulic intensifiers 54 may include a first piston 58 within the first chamber 56, and a second piston 60 within a second chamber 62 (e.g., high pressure chamber). The first piston 58 may include a first cross-sectional area (e.g., surface area in contact with the input fluid in the first chamber 56), and the second piston 60 may include a second cross-sectional area (e.g., surface area in contact with an output fluid, also referred to herein as a hydraulic actuating fluid) in the second chamber 62. This configuration enables each of the multiple hydraulic intensifiers 54 to intensify (e.g., increase the pressure) of the output fluid (e.g., to at least 138 MPa (e.g., about 10,000 psi), as discussed in more detail below. The degree of the intensification (e.g., pressure increase) varies with (e.g., is proportional to) a difference between the first cross-sectional area and the second cross-sectional area.

As used herein, the terms "upstream" and "downstream" are relative to a direction of flow from the fluid tank 52 to the lower portion 28 of the landing string 24. For example, the fluid tank 52 is upstream of the multiple hydraulic intensifiers 54. In the illustrated embodiment, a filter 70 is provided along the one or more umbilicals 34 upstream of the multiple hydraulic intensifiers 54. A valve 72 (e.g., shuttle valve) may be positioned downstream of the multiple hydraulic intensifiers 54 in order to isolate the second chambers 62 and to block backflow of the output fluid into the second chambers 62. The valve 72 may enable the output fluid to flow toward the lower portion 28 of the landing string 24 while only one (e.g., either one), some, or all of the multiple hydraulic intensifiers 54 are in operation.

Furthermore, the modular hydraulic intensification system 32 may include at least one directional control valve 76 (e.g., surface piloted valve; piloted control valve), which may be controlled between a first valve position and a second valve position. In the first valve position, the directional control valve 76 may enable a flow of the output fluid from the second chambers 62 of the multiple hydraulic intensifiers 54 to actuate one or more valves (e.g., landing string valves) of the lower portion 28 of the landing string 24, such as to maintain the SCSSV valve in an open position. In the second valve position, the directional control valve 76 may block the flow of the output fluid from the second chambers 62 of the multiple hydraulic intensifiers 54 to actuate the one or more valves of the lower portion 28 of the landing string 24, but may enable fluid from the lower portion 28 of the landing string 24 to vent (e.g., to the riser 22 of FIG. 1.) In some embodiments, a valve-control umbilical 74 may extend from the fluid tank 52 or other fluid source to provide fluid to adjust the directional control valve 76 between the first valve position and the second valve position.

In some embodiments, multiple directional control valves 76 may be provided, such as to provide the output fluid in a targeted or desired manner to a particular valve of the lower portion 28 of the landing string 24. For example, a first directional control valve **76*a* may be configured to provide the output fluid to a first valve 78*a* of the lower portion 28 of the landing string, while a second directional control valve 76*b* may be configured to provide the output fluid to a second valve 78*b* of the lower portion 28 of the landing string. As shown, a first line may extend from the valve 72 to the first valve 78*a*, a second line may split off from the first line at a split (e.g., tee) to extend from the split to the second valve 78*b*. The first directional control valve 76*a* may be positioned along the first line between the split and the first valve 78*a*, and the second directional control valve 76*b* may be positioned along the second line between the split and the second valve 78*b*. While the first directional control valve 76*a* is in the second valve position and the second directional control valve 76*b* is in the first valve position, the output fluid may be directed to the second valve 78*b* of the lower portion 28 of the landing string 24. Similarly, while the second directional control valve 76*a* is in the second valve position and the first directional control valve 76*b* is in the first valve position, the output fluid may be directed to the first valve 78*a* of the lower portion 28 of the landing string 24. It should be appreciated that each of the multiple directional control valves 76 may be actuated via fluid through a respective valve-control umbilical 74 to enable the independent control of the multiple directional control valves 76 and the corresponding valves 78 (e.g., independent control of the first directional control valve 76*a* and the second directional control valve 76*b* to independently adjust the first valve 78*a* and the second valve 78*b***).

While the illustrated embodiment includes two hydraulic intensifiers 54 in parallel, any suitable number (e.g., 1, 2, 3, 4, 5, or more) hydraulic intensifiers 54 may be provided. In embodiments with multiple hydraulic intensifiers 54, the multiple hydraulic intensifiers 54 may be arranged in parallel to provide increased flow rates (e.g., when used simultaneously) and/or redundancy (e.g., when used separately), for example. It should also be appreciated that other features may be included in the modular hydraulic intensification system 32. For example, fluid from the fluid tank 52 or from another source may be provided to prime the modular hydraulic intensification system 32 and/or may be provided at the second chamber 62 or at any suitable location between the second chamber 62 and the lower portion 28 of the landing string 24. Then, the multiple hydraulic intensifiers 54 may operate to intensify the pressure of this fluid (e.g., the output fluid) to enable actuation of the one or more valves of the lower portion 28 of the landing string 24.

Furthermore, the modular hydraulic intensification system 32 may be controlled via a controller 80 (e.g., electronic controller). In the illustrated embodiment, the controller 80 includes a processor 82 and a memory device 84. The controller 80 may also include one or more storage devices, communication devices, and/or other suitable components. The processor 82 may be used to execute software, such as software for controlling a flow of the input fluid from the fluid tank 52 to the first chamber 56 to adjust the hydraulic intensifier(s) 54, a flow of the fluid to the directional control valve 76, and so forth. Moreover, the processor 82 may include multiple microprocessors, one or more "general-purpose" microprocessors, one or more special-purpose microprocessors, and/or one or more application specific integrated circuits (ASICS), or some combination thereof. For example, the processor 82 may include one or more reduced instruction set (RISC) processors.

The memory device 84 may include a volatile memory, such as random access memory (RAM), and/or a nonvolatile memory, such as ROM. The memory device 84 may store a variety of information and may be used for various purposes. For example, the memory device 84 may store processor-executable instructions (e.g., firmware or software) for the processor 82 to execute, such as instructions for controlling the modular hydraulic intensification system 32. The storage device(s) (e.g., nonvolatile storage) may include read-only memory (ROM), flash memory, a hard drive, or any other suitable optical, magnetic, or solid-state storage medium, or a combination thereof. The storage device(s) may store data (e.g., position data, pressure data), instructions (e.g., software or firmware for controlling the modular hydraulic intensification system 32), and any other suitable data.

In certain embodiments, the controller 80 is an electronic controller having electrical circuitry configured to process data from a sensor 88 (e.g., pressure sensor). The controller 80 may be configured to control a pump (e.g., at the platform) to adjust the flow of the input fluid to the first chamber 56. For example, an increase in pressure of the input fluid drives the first piston 58 and the second piston 60 connected thereto in order to increase the pressure of the output fluid at the second chamber 62 (e.g., due to the difference between the first-cross sectional area and the second cross-sectional area) so as to maintain a desired pressure (e.g., range) at the sensor 88, for example. The desired pressure may be preprogrammed in the memory device 84 or input by an operator, for example. To reach and/or to maintain the desired pressure, the sensor 88 may detect the pressure of the fluid between the second chamber(s) 62 and the lower portion 28 of the landing string 24 (e.g., between the directional control valve 76 and the lower portion 28 of the landing string 24), provide a signal indicative of the pressure to the processor 82, and the processor 82 may provide a signal to the pump and/or to a valve upstream of the multiple hydraulic intensifiers 54 to adjust a flow of the input fluid to the first chamber 56 until the signal from the sensor 88 indicates that the desired pressure has been reached. In some embodiments, the controller 80 may additionally or alternatively instruct other operations, such as to increase a number of the multiple hydraulic intensifiers 54 that are in operation (e.g., supplying intensified output fluid), control one or more actuators to adjust one or more valves, such as one or more of the directional control valves 76.

It should be appreciated that the controller 80 may be configured to operate the components of the modular hydraulic intensification system 32 based on inputs from the operator (e.g., via a user interface) and/or via inputs from one or more sensors within the landing string 24. For example, the inputs may indicate an increase in pressure at the lower portion 28 of the landing string 24, and the controller 80 may then control a pump to adjust a flow of actuation fluid to one of the directional control valves 76 adjust the directional control valve 76 to the second position to enable the one or more valves 78 of the lower portion 28 of the landing string 24 to move from an open position to a closed position (e.g., in the case of a fail-closed valve or valve that is biased toward the closed position) to block a bore through the lower portion 28 of the landing string 24 (e.g., to isolate components of the subsea system 10 that are positioned vertically above the lower portion 28 of the landing string 24 relative to the vertical axis 36).

Similarly, the inputs may indicate that the one or more valves 78 of the lower portion 28 of the landing string 24 should be maintained in an open position for downhole operations. In such cases, the controller 80 may receive feedback from the sensor 88 and may control components to adjust the flow of the input fluid to the first chamber 56 to maintain the desired pressure at the sensor 88. In this way, the modular hydraulic intensification system 32 may provide the output pressure, which is at a higher pressure than the input pressure that flows from the tank 52 through the umbilicals 34, to the one or more valves 78 of the lower portion 28 of the landing string 24 (e.g., to hold the one or more valves 78 in the open position). It should be appreciated that the embodiments disclosed herein may be utilized with fail-close (e.g., biased closed) and/or fail-open (e.g., biased open) valves. Thus, the output fluid may be used to maintain the valves in the open position and/or the closed position against a biasing force of a biasing member.

Figure 3:
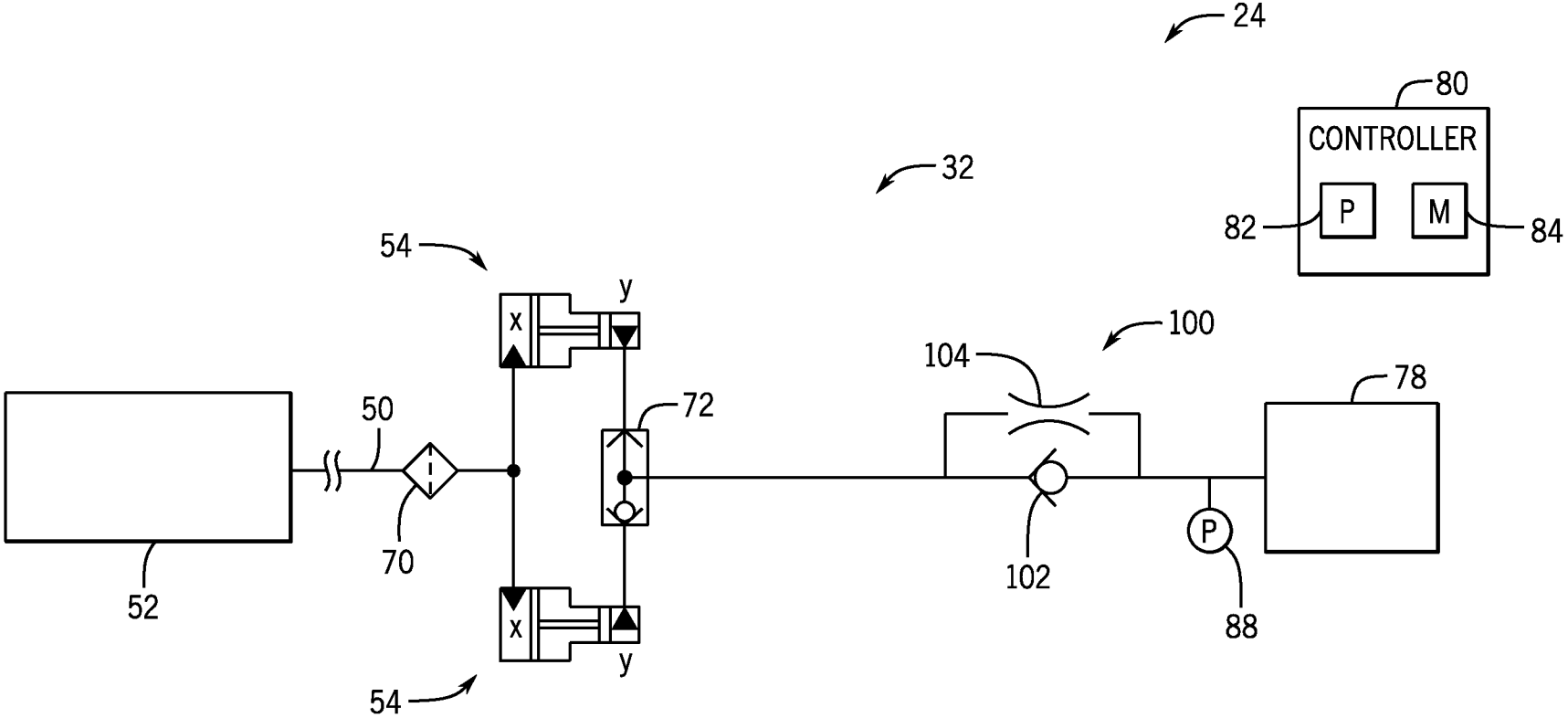
FIG. 3 is a schematic illustration of the modular hydraulic intensification system of FIG. 1, wherein the modular hydraulic intensification system includes a bleed off circuit, according to an embodiment of the present disclosure.

FIG. 3 illustrates a schematic diagram of an embodiment of the modular hydraulic intensification system 32 that may be used in the landing string 24, wherein the modular hydraulic intensification system 32 includes a bleed off circuit 100. As shown, the bleed off circuit 100 may include a one-way valve 102 and a restrictor 104 (e.g., choke valve). The bleed off circuit 100 may operate to choke back (e.g., reduce a flow rate of) high-pressure returns from the one or more valves 78 of the lower portion 28 of the landing string 24.

In the illustrated embodiment, the bleed off circuit 100 may be used instead of the directional control valve 76. However, it should be appreciated that the bleed off circuit 100 may be used in combination with the directional control valve 76 and the related features (e.g., a drain) of FIG. 2. For example, the bleed off circuit 100 may be used between the valve 72 and the directional control valve 76 to choke back the high-pressure returns while the directional control valve 76 is in the first valve position, or the bleed off circuit 100 may be used between the directional control valve 76 and the one or more valves of the lower portion 28 of the landing string 24 to choke back the high-pressure returns while the directional control valve 76 is in the first valve position and/or the second valve position. Multiple bleed off circuits 100 may be used, such as in embodiments having multiple directional control valves 76 and/or in cases where the output fluid is supplied to multiple different valves 78 of the lower portion 28 of the landing string 24.

Figure 4:
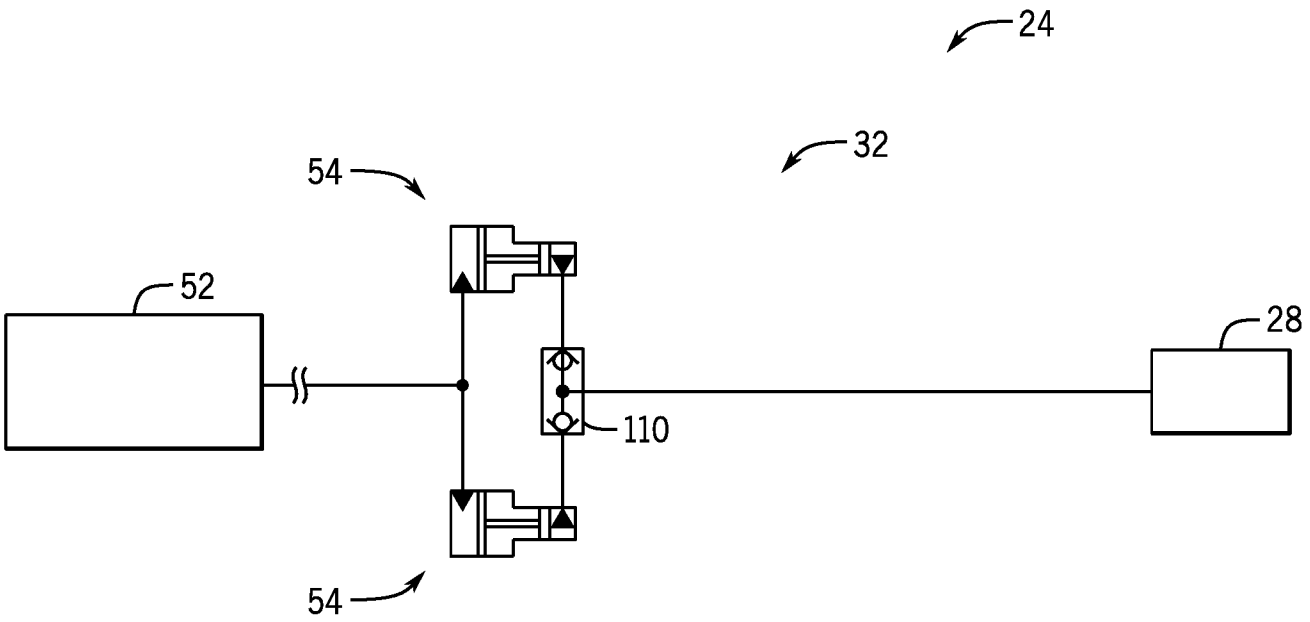
FIG. 4 is a schematic illustration of the modular hydraulic intensification system of FIG. 1, wherein the modular hydraulic intensification system is configured to provide chemical injection, according to an embodiment of the present disclosure.

FIG. 4 illustrates a schematic diagram of the modular hydraulic intensification system 32, wherein the modular hydraulic intensification system 32 is configured to provide chemical injection, such as via ports along the lower portion 28 of the landing string 24. In this example, the modular hydraulic intensification system 32 is used as a control circuit for chemical injections and no returns are managed. In some embodiments, a dual-shuttle isolation valve 110 may be used to isolate both hydraulic intensifiers 54 from the output fluid downstream of the dual-shuttle isolation valve 110 (e.g., between the dual-shuttle isolation valve 110 and the ports along the lower portion 28 of the landing string 24). As noted above, with respect to FIG. 2, any number of hydraulic intensifiers 54 may be placed in parallel as desired to increase flowrate, for example. The modular hydraulic intensification system 32 may be configured to use for both control of the one or more valves of the lower portion 28 of the landing string 24 (e.g., at some time) and for injection of chemicals at the lower portion 28 of the landing string 24 (e.g., at other times). In such cases, features (e.g., the directional control valve(s), the bleed off circuits) of FIGS. 2 and 3 may be included in the modular hydraulic intensification system 32. In some embodiments, multiple modular hydraulic intensification systems 32 may be provided in the landing string 24 (e.g., stacked along the vertical axis 36), such as one for valve control and one for chemical injection.

Advantageously, the modular hydraulic intensification system 32 is designed to be positioned subsea as part of the landing string 24. The modular hydraulic intensification system 32 may be used to provide desired control and injection pressures to one or more valves 78 in the lower portion 28 of the landing string 24 without designing and constructing expensive, custom high-pressure control systems. Additionally, faster, cheaper, and more efficient low-pressure control systems can be sourced for new builds and combined with the modular hydraulic intensification system 32. This greatly expands the number of vendors able to provide the desired equipment. Use of the modular hydraulic intensification system 32 described herein also can lower capital expenditures and provides a potential for use with existing control systems from a given service fleet.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. Furthermore, any of the features shown and/or described with respect to FIGS. 1-4 may be combined in any suitable manner.

What is claimed is:

1. A modular hydraulic intensification system for use in a subsea landing string, the modular hydraulic intensification system comprising:

a housing configured to be deployed within the subsea landing string;

a plurality of hydraulic intensifiers positioned within the housing, wherein each hydraulic intensifier of the plurality of hydraulic intensifiers comprises a first chamber configured to fluidly couple to a hydraulic fluid supply and a second chamber configured to fluidly couple to one or more landing string valves within a lower portion of the subsea landing string; and a shuttle valve fluidly coupled to the respective second chambers of the plurality of hydraulic intensifiers, wherein the shuttle valve is configured to enable flow of an output fluid across the shuttle valve from the respective second chambers of the plurality of hydraulic intensifiers toward the one or more landing string valves and to block backflow of the output fluid across the shuttle valve toward the respective second chambers of the plurality of hydraulic intensifiers.

2. The modular hydraulic intensification system of claim 1, comprising a pilot operated valve in fluid communication with the shuttle valve on a downstream side of the shuttle valve.

3. The modular hydraulic intensification system of claim 1, comprising a bleed off circuit in fluid communication with the shuttle valve on a downstream side of the shuttle valve.

4. The modular hydraulic intensification system of claim 1, comprising a filter positioned between the plurality of hydraulic intensifiers and the hydraulic fluid supply.

5. The modular hydraulic intensification system of claim 1, wherein the plurality of hydraulic intensifiers is positioned in a parallel arrangement.

6. The modular hydraulic intensification system of claim 1, comprising a pressure sensor positioned between the respective second chambers of the plurality of hydraulic intensifiers and the one or more landing string valves of the lower portion of the subsea landing string, and a controller configured to receive a signal indicative of a pressure at the pressure sensor and to adjust an input pressure of the hydraulic fluid supply until the pressure at the pressure sensor reaches a desired pressure.

7. The modular hydraulic intensification system of claim 1, comprising a controller and a pilot operated control valve, wherein the controller is configured to adjust a flow of control fluid to the pilot operated control valve to adjust the pilot operated control valve from a first position to a second position to block the flow of the output fluid to the one or more landing string valves of the lower portion of the subsea landing string.

8. A landing string system, comprising:

a lower portion configured to be landed within a stack assembly of a subsea system, wherein the lower portion comprises one or more valves that are configured to seal a bore to block a flow of well fluid from a wellbore toward a surface; and a modular hydraulic intensification system coupled to the lower portion, wherein the modular hydraulic intensification system comprises:

a first hydraulic intensifier and a second hydraulic intensifier, wherein the first hydraulic intensifier and the second hydraulic intensifier each comprise a respective low-pressure chamber that is configured to fluidly couple to a hydraulic fluid supply at the surface and a high-pressure chamber configured to fluidly couple to the one or more valves within the lower portion of the landing string system; and a shuttle valve fluidly coupled to the respective high-pressure chambers of the first hydraulic intensifier and the second hydraulic intensifier, wherein the shuttle valve is configured to enable flow of an output fluid across the shuttle valve from the respective high-pressure chambers of the first hydraulic intensifier and the second hydraulic intensifier and to block backflow of the output fluid across the shuttle valve toward the respective high-pressure chambers of the first hydraulic intensifier and the second hydraulic intensifier.

9. The landing string system of claim 8, comprising one or more ports configured to enable chemical injection into the lower portion of the landing string system, wherein the respective high-pressure chambers of the first hydraulic intensifier and the second hydraulic intensifier are fluidly coupled to the one or more ports.

10. The landing string system of claim 8, wherein the modular hydraulic intensification system comprises a housing positioned between a tubular of the landing string system and the lower portion of the landing string system.

11. The landing string system of claim 8, wherein the modular hydraulic intensification system is positioned at least partially within a marine drilling riser that extends between the stack assembly having one or more blowout preventers and a platform at the surface.

12. The landing string system of claim 8, further comprising a pilot operated valve in fluid communication with the shuttle valve on a downstream side of the shuttle valve.

13. The landing string system of claim 8, comprising:

a first line that extends from the shuttle valve to a first valve of the one or more valves of the lower portion of the landing string system to thereby fluidly couple the respective high-pressure chambers of the first hydraulic intensifier and the second hydraulic intensifier to the first valve of the one or more valves of the lower portion of the landing string system; and a second line that splits off from the first line at a tee to fluidly couple the respective high-pressure chambers of the first hydraulic intensifier and the second hydraulic intensifier to a second valve of the one or more valves of the lower portion of the landing string system.

14. The landing string system of claim 13, comprising a first pilot operated valve positioned along the first line between the tee and the first valve, and a second pilot operated valve positioned along the second line between the tee and the second valve.

15. The landing string system of claim 8, comprising a bleed off circuit in fluid communication with the shuttle valve on a downstream side of the shuttle valve.

16. The landing string system of claim 8, wherein the first hydraulic intensifier and the second hydraulic intensifier are positioned in a parallel arrangement.

17. The landing string system of claim 8, comprising a pressure sensor positioned between the respective high-pressure chambers of the first hydraulic intensifier and the second hydraulic intensifier and the one or more valves of the lower portion of the landing string system, and a controller configured to receive a signal indicative of a pressure at the pressure sensor and to adjust an input pressure of the hydraulic fluid supply until the pressure at the pressure sensor reaches a desired pressure.

18. The landing string system of claim 8, comprising a controller and a pilot operated control valve, wherein the controller is configured to adjust a flow of control fluid to the pilot operated control valve to adjust the pilot operated control valve from a first position to a second position to block the flow of the output fluid to the one or more valves of the lower portion of the landing string system.

19. A method of operating a modular hydraulic intensification system, the method comprising:

receiving, at respective low-pressure chambers of a plurality of hydraulic intensifiers, an input fluid at a first pressure;

outputting, at respective high-pressure chambers of the plurality of hydraulic intensifiers, an output fluid at a second pressure that is greater than the first pressure; and enabling the output fluid to flow from the respective high-pressure chambers of the plurality of hydraulic intensifiers toward one or more valves of a lower portion of a landing string and blocking the output fluid from returning to the respective high-pressure chambers of the plurality of hydraulic intensifiers via a shuttle valve.

20. The method of claim 19, comprising controlling a flow of fluid to adjust a pilot operated control valve between a first position in which the pilot operated control valve enables the output fluid to flow to the one or more valves of the lower portion of the landing string and a second position in which the pilot operated control valve blocks the output fluid from flowing to the one or more valves of the lower portion of the landing string.

* * * * *